United States Patent [19]

Thomas

[11] Patent Number: 4,872,621

[45] Date of Patent: Oct. 10, 1989

[54] SPRING DYE TUBE

[75] Inventor: Alvin D. Thomas, Valatie, N.Y.

[73] Assignee: Crellin, Inc., Chatham, N.Y.

[21] Appl. No.: 261,272

[22] Filed: Oct. 25, 1988

Related U.S. Application Data

[63] Continuation-in-part of Ser. No. 117,677, Nov. 5, 1987, abandoned.

[51] Int. Cl.[4] ..... B65H 75/20

[52] U.S. Cl. ..... 242/118.11

[58] Field of Search ..... 242/118.1, 118.11, 118.2, 242/118.3, 118.31, 118.32, 118; 68/189, 198

[56] References Cited

U.S. PATENT DOCUMENTS

| | | | |
|---|---|---|---|
| 3,465,984 | 9/1969 | Tigges et al. | 242/118.11 |
| 3,561,696 | 2/1971 | Hahm | 242/118.11 |
| 4,181,274 | 1/1980 | Burchette, Jr. | 242/118.11 |
| 4,270,710 | 6/1981 | Ono | 242/118.11 |
| 4,331,305 | 5/1982 | Marquis et al. | 242/118.11 |
| 4,454,734 | 6/1984 | Marquis | 242/118.11 X |
| 4,702,433 | 10/1987 | Gilljam et al. | 242/118.1 |

FOREIGN PATENT DOCUMENTS

| | | | |
|---|---|---|---|
| 0158323 | 10/1985 | European Pat. Off. | 242/118.11 |
| 0158324 | 10/1985 | European Pat. Off. | 242/118.11 |

*Primary Examiner*—Stanley N. Gilreath

*Attorney, Agent, or Firm*—Kane, Dalsimer, Sullivan, Kurucz, Levy, Eisele & Richard

[57] ABSTRACT

A spring dye tube has a pair of end rings and at least one support ring intermediate these rings and concentric therewith. A plurality of spaced, rigid V-shaped ribs are integrally formed with the rings and define therewith an initially rigid network or winding yarn to be dyed through which dye can flow. The ribs are arranged in separate spaced groups so as to tend to collapse axially upon the application of a predetermined force thereon. A non-collapsible rigid, torque resistant section extends from each end ring to strengthen the structure. Straight parallel members add rigidity and extend from one end ring to the other.

13 Claims, 4 Drawing Sheets

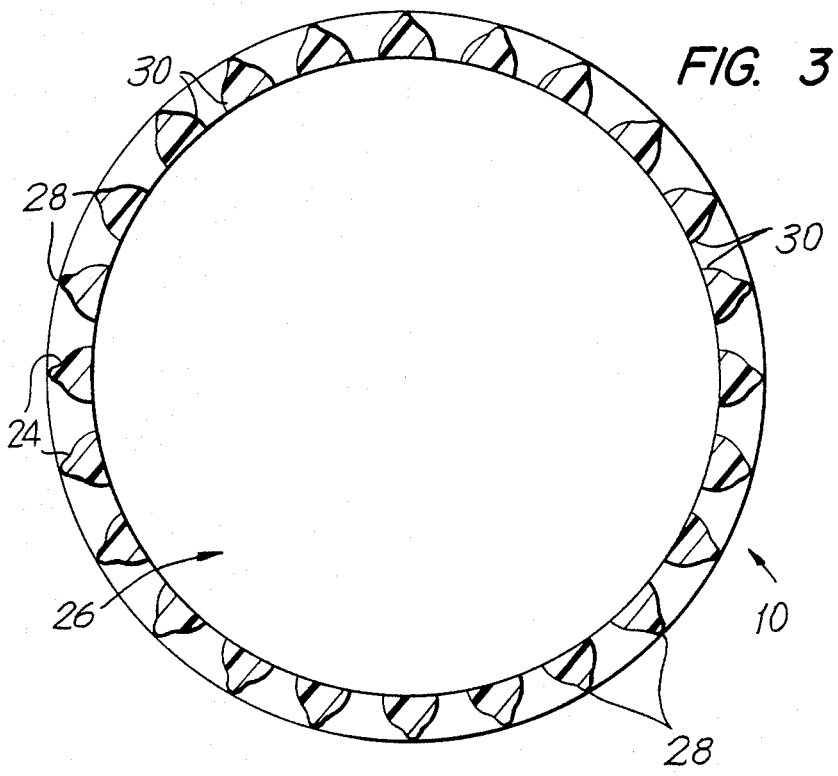
FIG. 3
FIG. 4
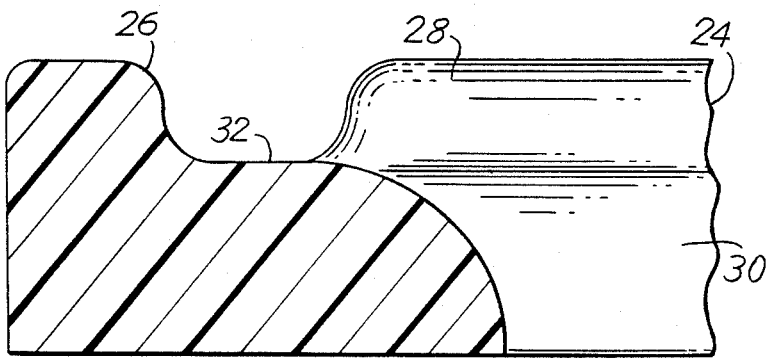

SPRING DYE TUBE

CROSS REFERENCE TO RELATED APPLICATION

This application is a continuation-in-part of U.S. patent application No. 117,677 filed Nov. 5, 1987, now abandoned.

BACKGROUND OF THE INVENTION

This invention relates generally to a dye tube resiliently compressible in the axial direction and to a tube of this type having a surface area of cylindrical shape with carrier elements disposed between end rings at the ends of the tube, the tube also has end rims with outer edges perpendicular to the mentioned surface areas, so that the tubes can be stacked one atop the next during the dyeing process.

STATEMENT OF PRIOR ART

The prior art as exemplified by U.S. Pat. Nos. 3,465,984 and 4,181,274 are generally illustrative of various devices of this type.

This background disclosure is restricted to those patents which are believed most relevant.

The dye spring tubes of the prior art were made of molded thermoplastic collapsible material which were disposable after a single use. The dye tube is wound with yarn and the yarn dyed. The yarn thereafter is wound off the tube and the tube is discarded. They dye tube of U.S. Pat. No. 4,181,274 comprises a pair of annular flanges and an intermediate structure between the flanges comprising at least one member extending generally axially to the length of the tube and a plurality of rigid members extending generally transversely to the length of the tube. The members are integrally formed by molding to initially define a rigid structure having an open network with at last some of these rigidly extending members being deformable by an axial force to cause axial compression of the tube. These members are referred to as ribs which form an open network to permit passage of dye therethrough.

Also pertinent is U.S. Pat. No. 3,465,984 which discloses a carrier resiliently compressible in the axial direction which comprises end rings and at least one intermediate ring with a plurality of ribs disposed between the end rings. These ribs are elastically bendable and equally distributed along the periphery of the carrier and inclined for at least a part of their length to the longitudinal axis of the carrier. The ribs' outer edges are oriented toward the surface of the carrier, the ribs being rigidly secured to the rings.

OBJECTS AND SUMMARIES OF THE INVENTION

The main object of this invention is to provide a device of this character which combines simplicity, strength, and durability in a high degree, together with inexpensiveness of construction.

A still further object of the invention is to provide a spring dye tube which has collapsible, nonbuckling extremities at each end of the collapsible central section, which providing sufficient spacing for the flow of dye solution therethrough.

It is yet another object of the present invention to provide a resiliently compressible dye tube having intermediate rings concentrically disposed relative to each other and connected by means of stays in order that the tube will not easily collapse in the radial direction.

A further object of the invention is to provide a spring tube made by means of injection molding of thermoplastic polymeric materials so as to provide an integral structure which does not require any finishing thereby reducing the cost of the tube to such extent that it is disposable.

It is a still further object of the invention to provide a spring dye tube having stays which are generally V-shaped connected with the carrier rings to form sections which are generally in the shape of parallelograms.

Another object of the invention is to provide a tube of this character wherein alternate rings are of different thicknesses.

An additional object of the invention is to provide nonbuckling, substantially noncompressible end sections formed of parallel stays connecting the end rings to outer concentric rims.

SUMMARY OF THE INVENTION

Broadly stated, the invention resides in a spring dye tube which has a pair of end rings and at least one support ring intermediate these rings and concentric therewith. A plurality of spaced, rigid V-shaped stays are integrally formed with the rings and define therewith an initially rigid network for winding yarn to be dyed and through which dye can flow. The stays are arranged in separate, spaced groups about the periphery of the tube so as to tend to collapse axially on one another upon the application of a predetermined force thereon. Also provided is a noncollapsible, rigid, torque and buckle-resistant section extending axially from each end ring to strengthen further the structure. Straight parallel stays extend from each end ring along the length of the tube and add further rigidity to the tube and prevent the spring dye tube from stretching in the axial direction during its winding cycle.

BRIEF DESCRIPTION OF THE DRAWING

In the accompanying drawing, in which are shown possible illustrative embodiments of the invention, and wherein like reference characters identify the same or like parts:

FIG. 3 is a horizontal cross-sectional view of the tube taken along the lines 3—3 in the direction of the arrows in FIG. 2;

FIG. 4 is a partial view of the end arrangement of the nonbuckling end section of the invention taken along line 4—4 in the direction of the arrows in FIG. 1; and, FIG. 5 is a partial side elevational view of an alternate embodiment of the tube according to the teachings of the present invention.

DESCRIPTION OF THE PREFERRED EMBODIMENT

Figure 1:
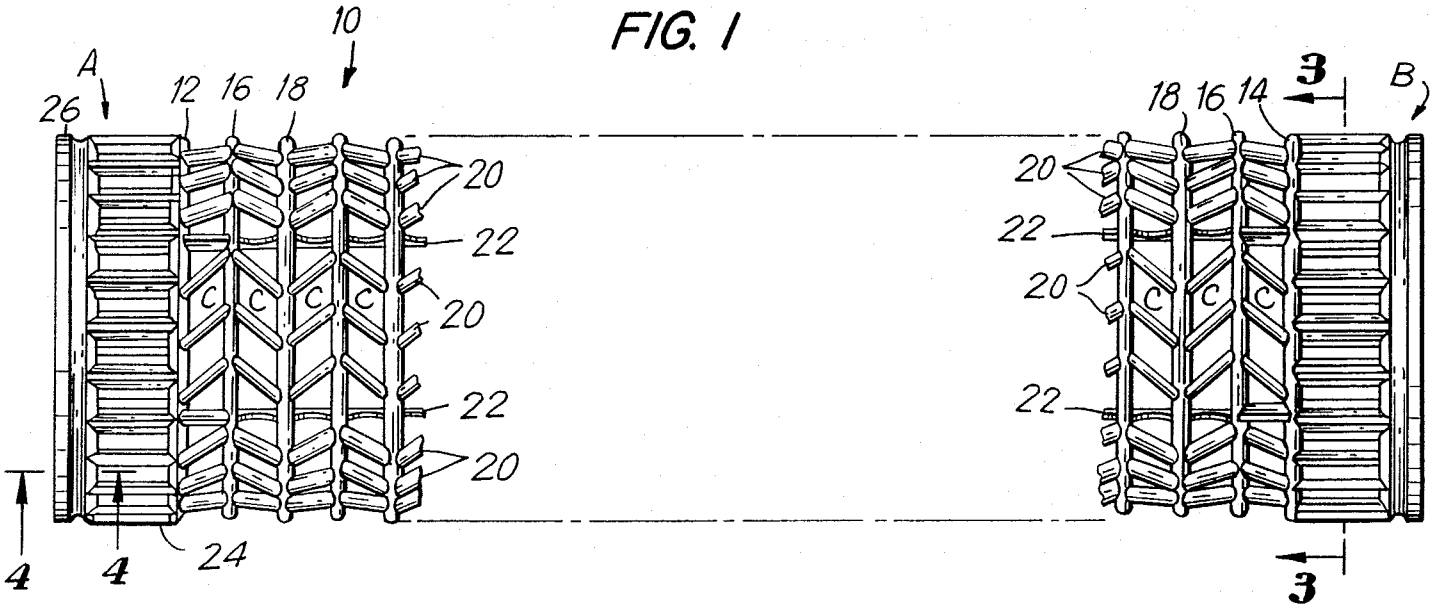
FIG. 1 is a partial side elevational view of a tube according to the teachings of the present invention.

With reference to the Figures, there is shown and illustrated a spring dye tube constructed according to the principles of the invention and designated by reference character 10 which comprises several interrelated major portions.

The tube generally indicated as 10 is provided with a pair of annular end rings 12 and 14 and a plurality of intermediate concentric rings 16 and 18. Rings 16 and 18 are of different thicknesses and alternately disposed in spaced relation between the end rings. Rings 12, 14, 16 and 18 are dimensioned as to size, length and width as to be accepted by the textile strand winder where yarn will be wound around the tube. As set forth, the rings preferably are circular in shape, as is the cross-sectional shape of the dye tube, but if desired other equivalent elements of different shapes may be used.

Figure 2:
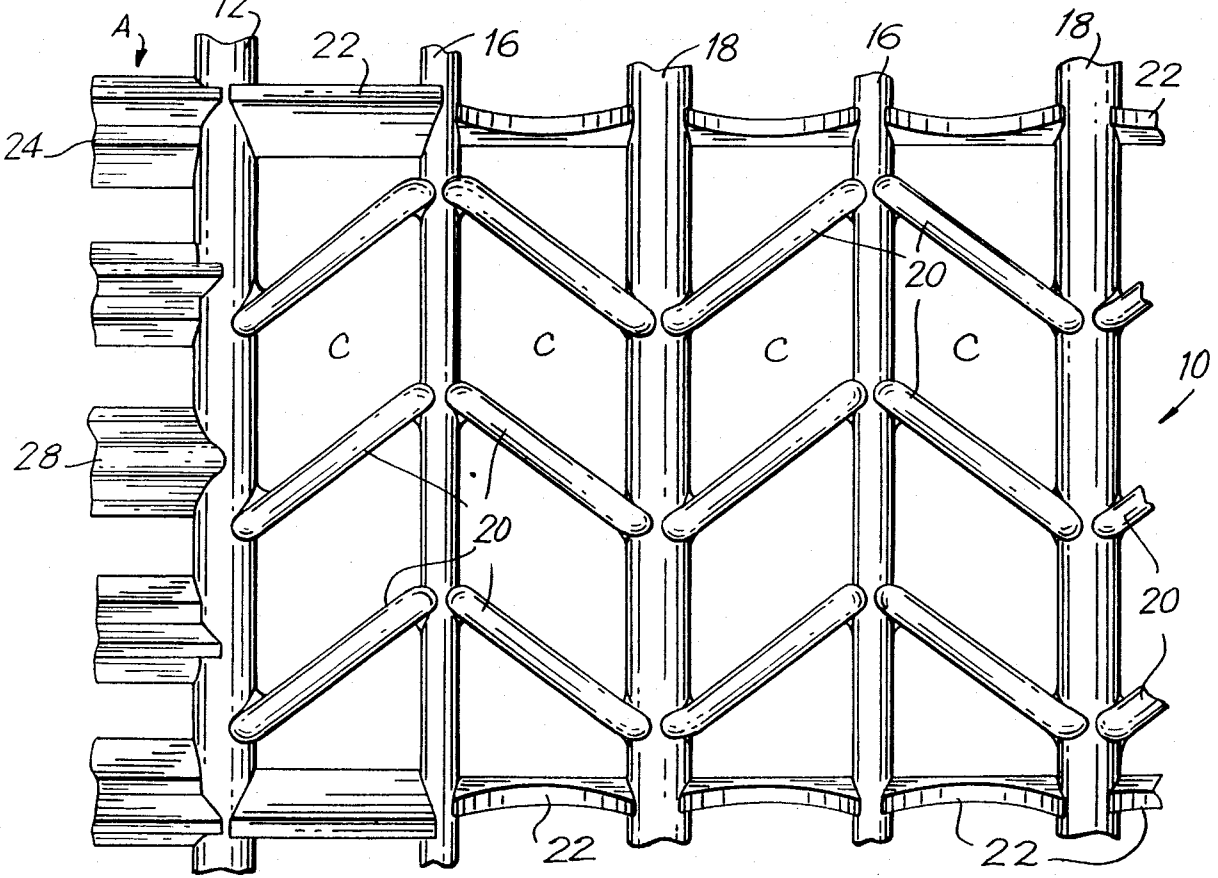
FIG. 2 is a partial side elevational view of the tube shown in FIG. 1.

The entire tube 10 preferably is injection molded from polypropylene and similar thermoplastic resins and modifications thereof. A plurality of rigid V shaped stays 20 extend from one end ring 12 to the other 14 in a wavy form and between the intermediate rings. Preferably these stays 20 are of the same radial dimensions as the rings 16 and are generally rectangular in cross-section. As shown, the wavyform or V-shaped stays 20 are spaced between pairs of longitudinal parallel members 22. Suitably, the number of stays 20 between each pair of straight members 22 will be the same, preferably 3, as shown in FIG. 2. However, more or less stays 20 may be used. Those portions of longitudinal parallel members 22 lying between end rings 12 and 14 and adjacent intermediate rings 16, as clearly shown in FIGS. 1 and 2, are thicker than the rest of the length of the longitudinal parallel members 22 running along the spring dye tube. Each end ring 12 and 14 is connected by means of spaced, parallel, thicker, ribs 24 to a rim 26. Rims 26 are separated from the end rings 12 and 14 by a distance greater than that separating the intermediate concentric rings 16 and 18.

As shown in FIGS. 3 and 4, each of the ribs 24 are of approximate triangular form with its apex 28 pointing upwardly so as to maintain yarn wound thereon in position. It will be appreciated that owing to the thickness of ribs 24 there are provided two nonbuckling zones A and B at each extremity of the tube. These sections A and B resist any torque force or buckling pressure exerted on the tube.

In a preferred embodiment of the invention, the stays 20 can be said to extend in the form of inverted V-shaped elements between the thicker rings 12 and 18, for example, with their apexes at rings 16. Similarly, the stays 20 can be visualized as extending in a V-shaped form between successive rings 16 with their apexes at rings 18. In this fashion, an open network is formed on the periphery of the tube which consists of a series of parallelogram-shaped openings generally designated by the letter "C". These sections "C" are obliquely disposed with respect to successive openings.

As mentioned above, the spring dye tube of the invention is preferably integral and is formed by injection molding of a thermoplastic polymeric composition such as polypropylene that can withstand the various dyeing temperatures experienced.

Referring to FIG. 4 it will be seen that the rim 26 has a section of reduced diameter 32 which aids in preventing snagging of the yarn. Further, this section of reduced diameter 32 in rim 26 is necessary for fiber removal as it prevents the yarn from spilling beyond the edge 26 of the tube 10. Further, this section of reduced diameter 32 may be used as a tailing slot under some circumstances. Ribs 24 have an enlarged interior portion 30 in order to strengthen ribs 24.

Figure 6:
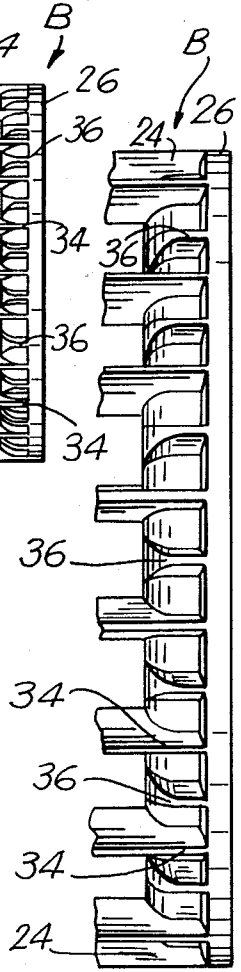
FIG. 6 is a detailed illustration of an end of the embodiment of the tube shown in FIG. 5.
Figure 5:
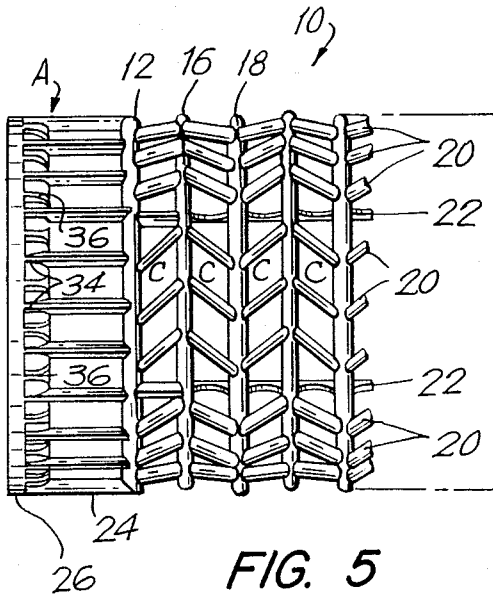

FIG. 5 shows an alternate embodiment of the spring dye tube of the present invention. As illustrated there it is substantially the same as that shown in FIG. 1 except that the section of reduced diameter 32 on the rim 26 at each end of the tube 10 is not continuous around the circumference of the rim 26. Rather, the section of reduced diameter 32 is interrupted about its circumference by extensions 34 of the apexes 28 of ribs 24 in the nonbuckling zones A and B. Further, between the extensions 34 are ridges 36 oriented parallel to the apexes 28 and their extensions 34 and having approximately the same axial width as the section of reduced diameter 32. FIG. 6 shows an enlarged view of an end of the tube 10 wherein the extensions 34 of the apexes 28 of ribs 24 and the ridges 36 are seen in greater detail.

In a particularly successful embodiment of the invention, the external diameter of the rings was 3.09 inches and the length of the tube was 11.0 inches.

It will be obvious to those skilled in the art that many variations and modifications of the invention can be resorted to without departing from the spirit and scope of the invention which should be determined only by the following claims.

What is claimed is:

1. A spring dye tube, comprising:

a pair of end rings, at least one intermediate ring; said at least one intermediate ring being concentrically arranged relative to said end rings;

a plurality of wavyform elements disposed between the end rings and forming with said end rings and said at least one intermediate ring the periphery of said tube, said elements being grouped about said periphery; said groups being separated by elongated axial stiffening members extending from one of said end rings to the other and rigidly secured thereto;

and integral with each of said end rings a stiffening, antibuckling section including an outwardly extending end rim and a plurality of spaced parallel ribs securing said rim to an end ring.

2. A spring dye tube comprising:

a first and a second end ring;

a plurality of intermediate rings, said intermediate rings sharing a common axis with said first and second end rings;

a plurality of wavyform stays disposed between said first and second end rings, integrally connected to said first and second end rings and to said intermediate rings and forming an outer periphery of said spring dye tube, said wavyform stays disposed in groups about said periphery;

a plurality of elongated axial stiffening members extending from said first end ring to said second end ring and integrally connected to said first and second end rings and to said intermediate rings, said elongated axial stiffening members separating said groups of said wavyform stays; and a first and a second stiffening, antibuckling section integrally connected to said first and second end rings respectively, each said stiffening, antibuckling section including an outwardly extending end rim and a plurality of spaced, parallel ribs securing said end rim to its respective end ring.

3. The spring dye tube according to claim 2, wherein said outwardly extending end rim of said stiffening, antibuckling section has a section of reduced diameter adjacent to said plurality of spaced, parallel ribs.

4. The spring dye tube according to claim 3, wherein said plurality of spaced, parallel ribs extend axially across said section of reduced diameter, so that said section of reduced diameter is interrupted by extensions of said spaced, parallel ribs.

5. The spring dye tube according to claim 3, wherein said section of reduced diameter further comprises axially oriented ridges between said spaced, parallel ribs having substantially the same width in the axial direction as said section of reduced diameter.

6. The spring dye tube according to claim 2, wherein said groups of said wavyform stays and said intermediate rings constitute a plurality of parallelogram-shaped openings forming a network on the periphery of said tube.

7. The spring dye tube as set forth in claim 2, wherein said wavyform stays have a generally V-shape.

8. The spring dye tube as set forth in claim 2, wherein said wavyform stays are rectangular in cross-section.

9. The spring dye tube as set forth in claim 2, wherein said plurality of intermediate rings are of alternating different thicknesses as measured axially along said tube.

10. The spring dye tube according to claim 2 wherein said ribs in said stiffening section connecting said end rings to said rim are triangular in cross-section.

11. The spring dye tube according to claim 9, wherein said elongated axial stiffening members are of the same thickness as the thinner of said intermediate rings.

12. The spring dye tube according to claim 9, wherein said wavyform elements are equally spaced from one another and said rims are spaced from said end rings by a distance greater than that separating said intermediate rings.

13. The spring dye tube of claim 12, wherein said tube is composed of polymeric material selected from the group consisting of polypropylene, polycarbonate, polyethylene, and polymethylmethacrylate.

* * * * *